US008439410B2

(12) United States Patent
Sauder

(10) Patent No.: US 8,439,410 B2
(45) Date of Patent: May 14, 2013

(54) PREHUNG DOOR JAMB INSERT WITH SECURITY AND ADJUSTMENT FEATURES

(76) Inventor: Mark L. Sauder, Spencerville, IN (US)

( * ) Notice: Subject to any disclaimer, the term of this patent is extended or adjusted under 35 U.S.C. 154(b) by 420 days.

(21) Appl. No.: 12/702,011

(22) Filed: Feb. 8, 2010

(65) Prior Publication Data

US 2010/0201138 A1 Aug. 12, 2010

Related U.S. Application Data

(60) Provisional application No. 61/151,284, filed on Feb. 10, 2009.

(51) Int. Cl.
*E05B 15/02* (2006.01)

(52) U.S. Cl.
USPC .. 292/340; 292/341; 292/341.18; 292/341.19

(58) Field of Classification Search ..... 292/340, 292/341 X, 341.18 X, 341.19 X
See application file for complete search history.

(56) References Cited

U.S. PATENT DOCUMENTS

| | | | | |
|---|---|---|---|---|
| 4,369,994 | A | 1/1983 | Vorves | |
| 4,451,071 | A | 5/1984 | Striese et al. | |
| 4,492,392 | A | 1/1985 | Woods et al. | |
| 4,854,621 | A * | 8/1989 | Baldwin | 292/340 |
| 4,872,717 | A | 10/1989 | McEvoy et al. | |
| 5,070,650 | A * | 12/1991 | Anderson | 49/460 |
| 5,118,151 | A * | 6/1992 | Nicholas et al. | 292/341.19 |
| 5,456,507 | A | 10/1995 | Jones | |
| 5,752,728 | A * | 5/1998 | Matouschek | 292/340 |
| 5,757,269 | A * | 5/1998 | Roth et al. | 340/542 |
| 6,588,155 | B1 * | 7/2003 | Theune et al. | 49/504 |
| 7,207,608 | B2 * | 4/2007 | Monts de Oca | 292/341.18 |
| 7,669,902 | B2 * | 3/2010 | Orbeta | 292/340 |
| 7,900,981 | B2 * | 3/2011 | Hirschoff | 292/341.16 |
| 2005/0127692 | A1 * | 6/2005 | Sanders | 292/340 |
| 2006/0157991 | A1 * | 7/2006 | Nguyen | 292/341.18 |
| 2008/0224486 | A1 * | 9/2008 | Anderson | 292/340 |
| 2012/0056439 | A1 * | 3/2012 | Stendal | 292/340 |

OTHER PUBLICATIONS

Jamb Insert Strength Testing Procedure and Results. Armor Concepts; www.djarmor.com.

* cited by examiner

*Primary Examiner* — Carlos Lugo
*Assistant Examiner* — Mark Williams
(74) *Attorney, Agent, or Firm* — Barnes & Thornburg LLP

(57) ABSTRACT

A prehung door jamb assembly is provided that includes a strike plate mounting assembly configured to fasten to a door jamb. The strike plate mounting assembly includes a longitudinal extending support plate, a longitudinal extending second plate, first and second strike plate supports, a spacer, at least one adjustment fastener, and at least one fastener.

8 Claims, 5 Drawing Sheets

PREHUNG DOOR JAMB INSERT WITH SECURITY AND ADJUSTMENT FEATURES

The present application is related to and claims priority to U.S. Provisional Patent Application, Ser. No. 61/151,284, filed on Feb. 10, 2009, entitled "Prehung Door Jamb with Security and Adjustment Features. To the extent not included below, the subject matter disclosed in that application is hereby expressly incorporated into the present application

TECHNICAL FIELD AND SUMMARY

This disclosure relates generally to doors. More particularly, the disclosure relates to manufactured door jambs used with prehung doors for residential and commercial buildings, and specifically to such door jambs having certain security and adjustment features which provide for ease of use and installation, and heightened security and resistance to break-ins.

Wooden door jambs that are in wide use today have a security problem. A burglar kicking in the door, or slamming his shoulder into it, may break apart the inside edge of the wood jamb. In most instances, there is only a ½"×¾" piece of soft wood in the jamb that needs to be broken to kick the door in. A dead bolt is designed to increase the amount of force required to kick in the door. It has a longer bolt, and is supplied with a larger strike plate with long screws. The screws help by going through the ¾" jamb, through the gap between the door jamb, the rough framed opening, and into the wall stud. The longer door bolt goes through the ¾" thick jamb, but it does not usually project through the rough opening gap and into the stud. Such doors can be easily broken into, even with a dead bolt installed.

Existing strike plates are typically not adjustable. The strike plate for the dead bolt is most often installed by hand by mortising it into the wood jamb with a hammer and chisel. This process is time consuming and is not adjustable. The alignment of the strike plate has to be correct for the door hardware to operate. Sometimes it is necessary to move the strike plate a small amount. To move the strike plate, the wood mortise has to be altered with a chisel. Then the screw holes need to be moved. Moving the screw holes a small amount is difficult because the screws tend to slide back into the original holes. Sometimes after the initial door installation, there is some movement in the door, or the adjoining wall and floor. This can require strike plate adjustment for the door hardware to work properly. When making these adjustments, it is hard not to damage the paint and finished wood.

Entrance doors are usually delivered to the job site prehung. That is, the door is already installed in the door jamb assembly. Carpenters frame a rough opening that is larger than the outside dimensions of the prehung door. The door is installed in the rough opening. The bottom of the prehung door is leveled and the sides are plumbed. There is an operating margin between the door and its jamb that needs to be maintained. This margin is set by the carpenters when they install the door. The carpenters use wood shims between the door jamb and the rough opening to help set it for plumb, level, and its margin.

An illustrative embodiment of the present disclosure provides a prehung door jamb assembly comprising a strike plate mounting assembly configured to fasten to a door jamb. The strike plate mounting assembly comprises: a longitudinal extending support plate with a plurality of holes disposed therethrough configured to receive fasteners that secure the support plate to the door jamb; a longitudinal extending second plate extending substantially orthogonal from the support plate; first and second strike plate supports, both extending substantially orthogonal to the second plate, spaced apart and over top of the support plate; each first and second strike plate support including a pair of strike plate fastener slots configured to permit adjustment of an attached strike plate substantially transverse to the longitudinal extent of both the support and second plates; each first and second strike plate support also includes an open area configured to receive a latch mechanism from either a handle set or a deadbolt; a spacer positioned between the first and second strike plate supports and including guide edges to limit movement of the strike plate to directions substantially transverse to the longitudinal extent of both the support and second plates; at least one adjustment fastener configured to extend through the support plate and configured to act as a spacer between the mounting assembly and a door rough-in, wherein the adjustment fasteners are adjustable to assist facilitating a desired spacing between the mounting assembly and the door rough-in; and at least one fastener configured to extend through the support plate and spacing and enter the door rough-in.

In the above and other illustrative embodiments, the prehung door jamb assembly may further comprise: the strike plate mounting assembly including first and second reinforcement tabs each positioned substantially parallel to the second plate and substantially orthogonal to the support plate and wherein the first reinforcement tab is located adjacent the open area of the first strike plate support and the second reinforcement tab is located adjacent the open area of the second strike plate support; the spacer being both spaced apart and over top of the support plate; a threaded bore in the support plate to receive corresponding threads from the adjustment fasteners; each adjustment fastener having a bore disposed therethrough configured to receive the fastener; a boss that receives one of the adjustment fasteners; and each fastener configured to extend through a bore in the adjustment fastener and extend into the door rough-in.

Another illustrative embodiment of the present disclosure provides prehung door jamb assembly comprising a door jamb and a strike plate mounting assembly. The strike plate mounting assembly is fastened to the door jamb. The strike plate mounting assembly comprises: a first portion adapted to be secured at multiple points to a surface of the door jamb; a second portion coupled to and extending substantially orthogonally from said first portion, said second portion being configured to align with an edge surface of the door jamb; a third portion coupled to said second portion and extending substantially orthogonally therefrom, said third portion comprising two sets of slots for receiving fasteners used to secure strike plates to said strike plate mounting assembly; and at least one adjusting screw extending through said first portion and contacting a building structure following installation of the prehung door jamb so as to support the strike plate mounting assembly relative to the building structure.

Additional features and advantages of the door jamb security feature assembly will become apparent to those skilled in the art upon consideration of the following detailed description of the illustrated embodiment exemplifying the best mode of carrying out the door jamb security feature assembly as presently perceived.

BRIEF DESCRIPTION OF THE DRAWINGS

The present disclosure will be described hereafter with reference to the attached drawings which are given as non-limiting examples only, in which.

Figure 1:
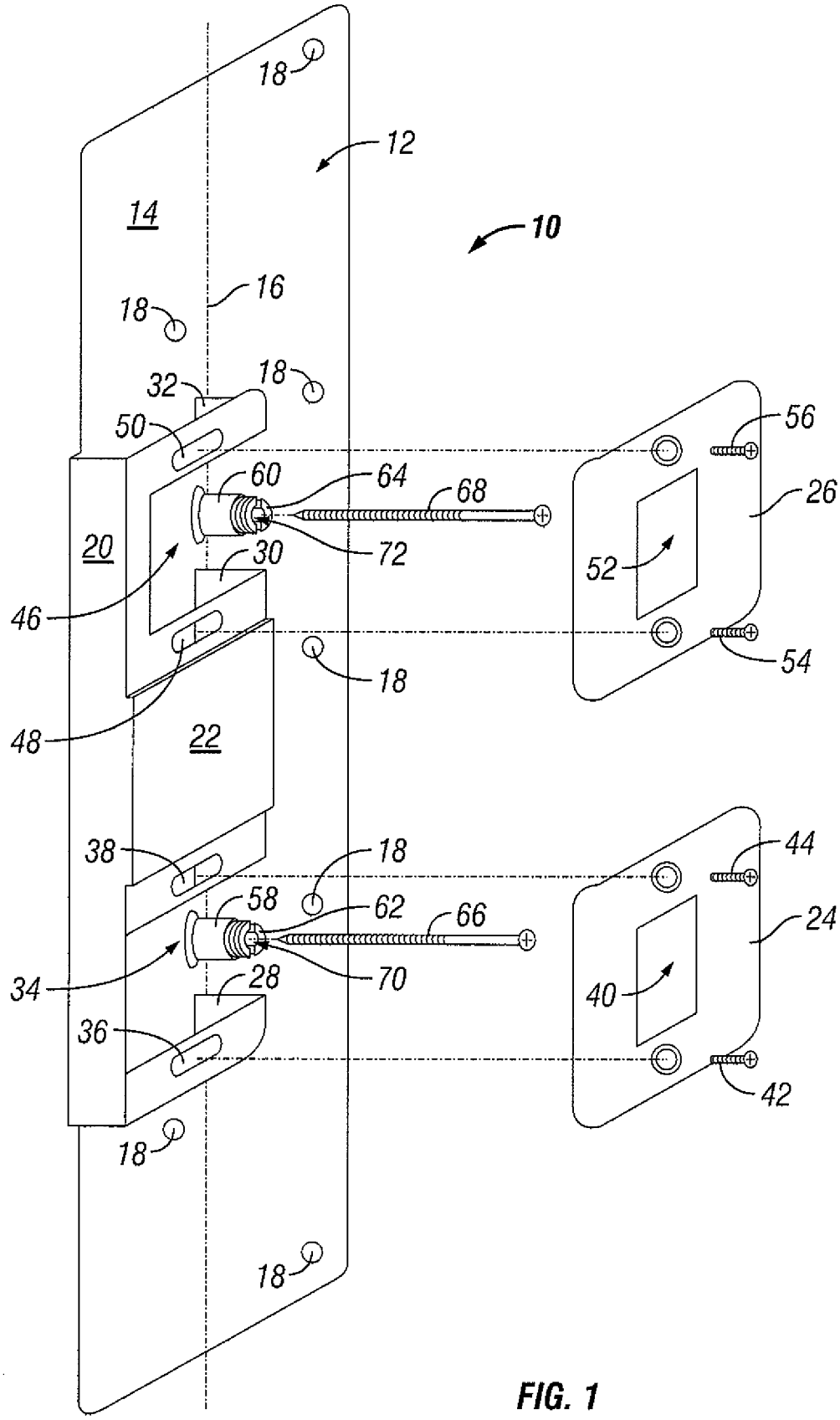
FIG. 1 shows an exploded view of an illustrative embodiment of strike plate mounting assembly.

Corresponding reference characters indicate corresponding parts throughout the several views. The exemplification set out herein illustrates embodiments of the strike plate mounting assembly, and such exemplification is not to be construed as limiting the scope of the strike plate mounting assembly in any manner.

DETAILED DESCRIPTION OF THE DRAWINGS

FIG. 1 shows an exploded view of a strike plate mounting assembly 10. According to this illustrative embodiment, assembly 10 includes a support plate 12 which comprises a rectangular portion 14 having a long axis 16 that is disposed vertically along a portion of a door jamb 80. (See also FIG. 2). A plurality of holes 18 are formed in rectangular portion 14 for receiving screws to secure support plate 12 to door jamb 80, as further illustrated in FIGS. 2 and 3.

Figure 2:
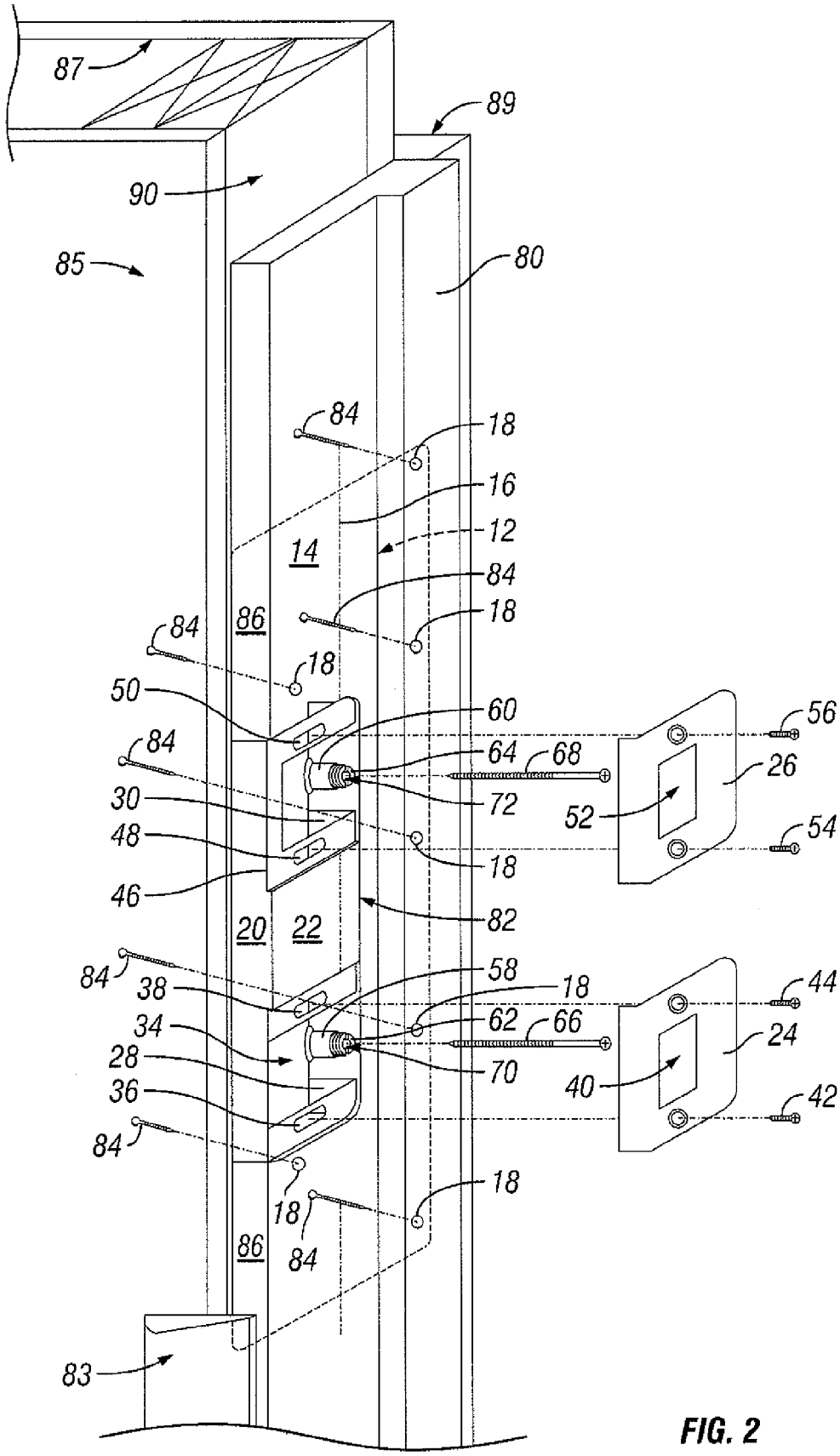
FIG. 2 shows the strike plate mounting assembly of FIG. 1 in relation to portions of a prehung door jamb and adjacent building structure.

In addition to rectangular portion 14, support plate 12 includes a relatively flat, rectangularly-shaped portion 20 disposed at a right angle to portion 14, and extending coaxially with axis 16. Portion 20 is configured to align with an edge surface of a portion of prehung door jamb 80, as illustrated in FIG. 2.

Extending at an approximate right angle from portion 20 is portion 22 which, as described below, is specifically configured to receive strike plates 24 and 26.

Extending at a right angle from portion 22 are portions 28, 30 and 32. In one embodiment, portions 14, 20, 22, 28, 30 and 32 are illustratively formed from a single piece of steel plate in a stamping operation, followed by a bending operation to produce the embodiment of support plate 12 illustrated in FIG. 1. Alternatively, assembly 10 can be manufactured from multiple pieces welded or otherwise attached together.

As illustrated in FIG. 1, portion 22 is formed to receive strike plates 24 and 26. Specifically, a lower portion of portion 22 includes a rectangularly-shaped open area 34 and two slots 36 and 38. Open area 34 provides clearance for a spring-loaded door latch mechanism extending through opening 40 in strike plate 24. Opening 40 is generously dimensioned in its vertical aspect (as oriented in FIG. 2) so as to allow for variations and adjustment in the vertical position of the door latch. Slots 36 and 38 provide surfaces which interact with threads of screws 42 and 44, respectively, which are used to secure strike plate 24 to portion 22. The configuration of slots 36 and 38 allow for lateral adjustment of strike plate 24 upon, and after, installation.

An opposing (top) portion of portion 22 is similarly formed to receive strike plate 26. That is, rectangular open area 46 is provided, along with two slots 48 and 50. Strike plate 26 is formed with an opening 52 (similarly dimensioned to allow for vertical adjustment and variations) designed to receive a bolt from a dead bolt locking mechanism. Open area 46 provides room to accommodate the dead bolt locking mechanism. As previously described in connection with strike plate 24, strike plate 26 is held in position on portion 22 by screws 54 and 56 which interact, respectively, with slots 48 and 50 (or with "captured" nuts or other thread receiving structure disposed in or behind the slots).

Disposed adjacent long axis 16 of support plate 12 are two threaded bosses 58 and 60. Threaded bosses 58 and 60 receive, respectively, adjusting screws 62 and 64.

Figure 3:
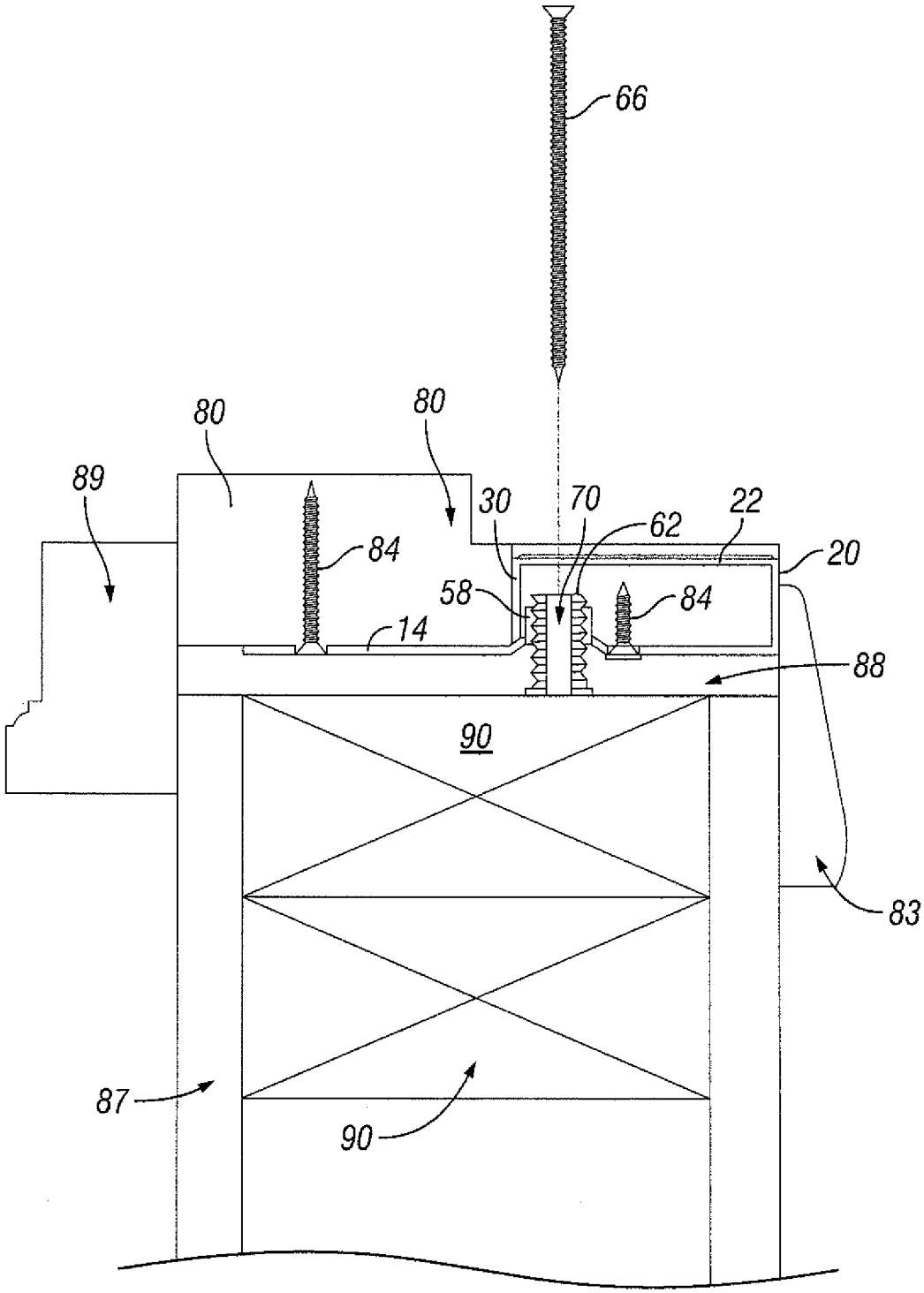
FIG. 3 shows a cross-sectional view of the strike plate mounting assembly and related structures shown in FIG. 2.

Screws 62 and 64 are used, as best illustrated in FIG. 3, to fill the gap between a prehung door jamb 80 and a stud 90 in a rough frame opening. After adjusting screw 62 and 64 have been adjusted to fit firmly against the stud, screws 66 and 68 are threaded through center openings 70 and 72, respectively, to secure assembly 10 and the door jamb to the stud.

FIG. 2 shows strike plate mounting assembly 10 of FIG. 1 attachable to prehung door jamb 80 and adjacent building structure. Support plate 12 is shown in position relative to part of a prehung door jamb 80. As illustrated, a rectangularly-shaped portion of door jamb 80 has been removed at 82 to provide clearance for portions 20, 22, 28, 30 and 32. Portion 20 is aligned with edge surface 86 of door jamb 80. Rectangular portion 14 is secured to an outer surface of prehung door jamb 80 by a plurality of screws 84 which extend through holes 18 into door jamb 80.

This view also shows how assembly 10 fits with respect to the adjacent building structures. For example, rectangular portion 14 is shown sitting between jamb 80 and wall stud 90. In this illustrative embodiment, portion 20 sits generally flush with edge surface 86 of door jamb 80 so that interior trim molding 83 can cover that edge without any additional requirements or modifications during installation of molding 83. Each side of wall stud 90 is a wall facing. The interior includes interior drywall 85, whereas the exterior includes subsiding 87 and exterior facing or trim 89. From this view, it is appreciated how the addition of assembly 10 does not interfere with the conventional constructional elements used around the vicinity of a door jamb.

FIG. 3 shows a cross-sectional view of strike plate mounting assembly 10 and related structures shown in FIG. 2. Visible in FIG. 3 is gap 88 that is present between prehung door jamb 80 and the rough frame opening in the building structure. As illustrated, adjusting screw 62 has been threaded inwardly so as to contact stud 90 to stabilize the prehung door jamb and strike plate mounting assembly 10 relative to the building structure. Screw 66 will be threaded through hole 70 and into stud 90 (and beyond) to further secure the assembly. Adjusting screw 64 (not shown in FIG. 3) is similarly positioned and secured.

Strike plate mounting assembly 10 is designed to be preinstalled in a prehung door jamb, preferably in a factory or shop, so as to save time and money on a construction site. Such preassembly further allows for more precise measurements and fittings, and facilitates the use of jigs, fixtures and tools not commonly available on construction sites. When properly installed, the assembly maintains a traditional jamb appearance. Adjustments to the strike plates and door margin (i.e., the gap between the prehung door jamb and rough frame opening) can be made with reduced chances for damaging painted surfaces. The steel box construction illustrated provides improved support and strength for door latches and dead bolts, greatly decreasing the possibility of jamb failure if the door is kicked or otherwise impacted. Use of stamping and bending operations to form strike plate mounting assembly 10 reduces the number of parts and operations required to form the assembly, thus reducing overall costs.

Figure 4:
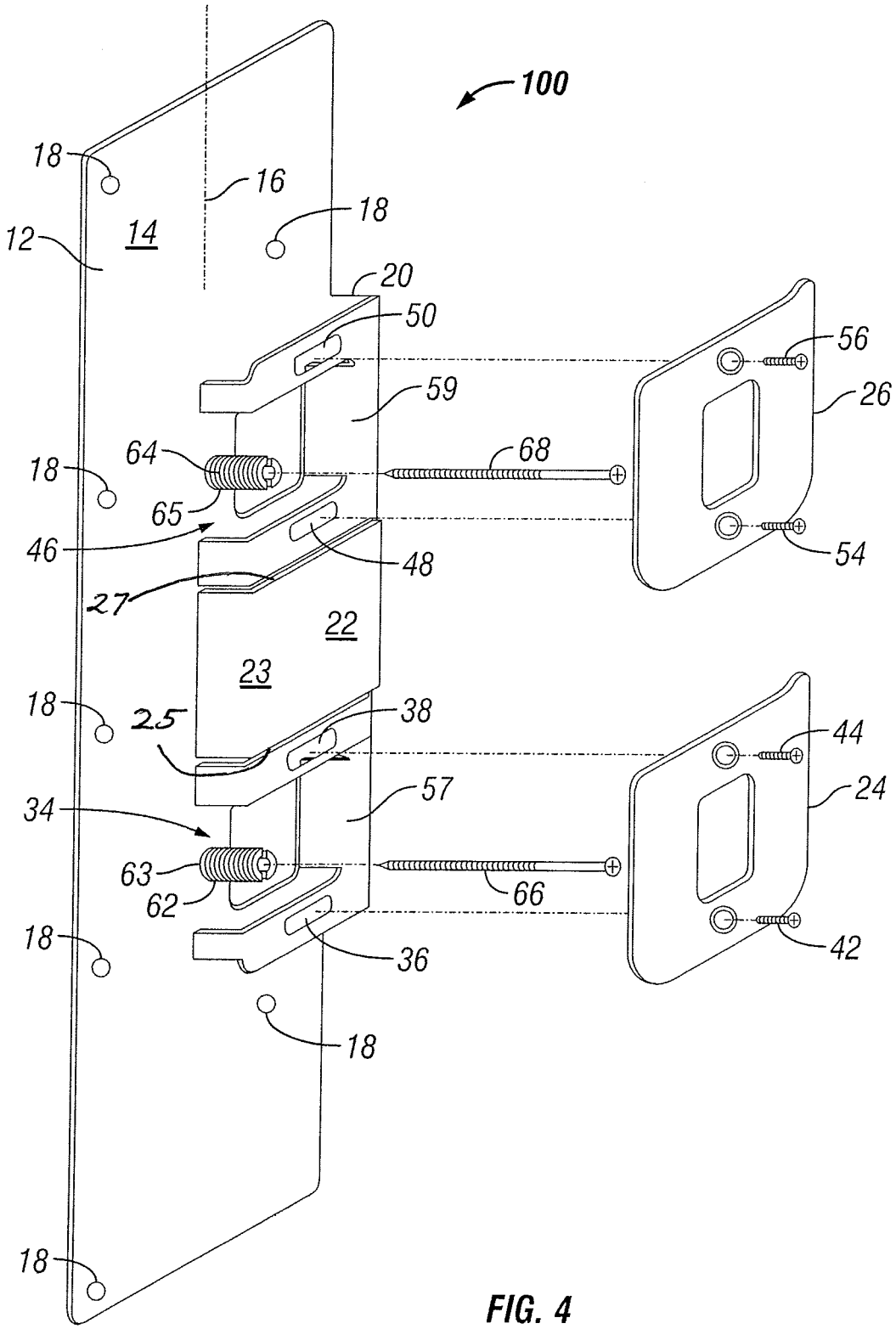
FIG. 4 shows an exploded perspective view of another illustrative embodiment of a strike plate mounting assembly.
Figure 5:
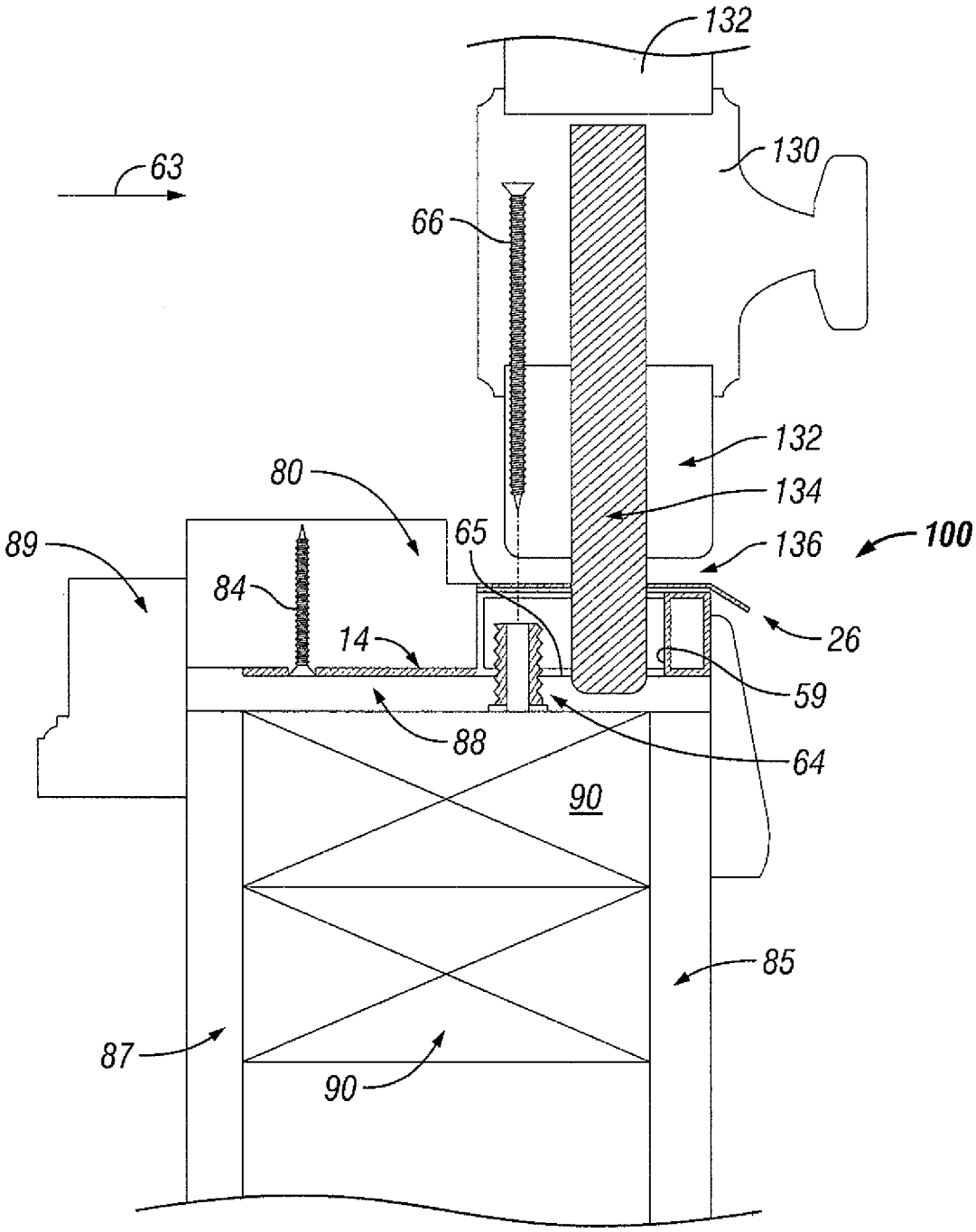
FIG. 5 shows a cross-sectional view of the strike plate mounting assembly according to FIG. 4.

A reverse perspective view of another illustrative embodiment of a strike plate mounting assembly 100 is shown in FIG. 4. Similar to the prior strike mounting plate assembly 10, this assembly also includes a support plate 12 with a rectangular portion 14 and axis 16 similar to assembly 10. Assembly 100 also fits onto door jamb 80 in the same manner as that described with respect to assembly 10. A plurality of holes 18 are disposed in rectangular portion 14 and configured to receive fasteners to secure plate 12 to jamb 80, as also previously discussed. Portion 20 extending from support plate 12 is similarly configured to align with the edge surface of a portion of the prehung door jamb 80, as shown in FIGS. 2 and 5. Portion 22 also includes strike plates 26 and 24. Fasteners 42, 44, 54, and 56 attach strike plates 24 and 26 to slots 48. Slots 36, 38, 48, and 50 likewise receive fasteners 42, 44, 54, and 56, respectively.

It is appreciated, as with the other embodiment, slots 36, 38, 48, and 50 can assist in greater adjustability of strike plates 24 and 26 when attaching to assembly 100 and aligning them with the door. These slots are configured to allow movement of the strike plates in a transverse direction to axis 16 previously discussed. Portion 22 can also have a spacer 23 between strike plates 24 and 26 to ensure proper initial alignment, again making the installer's job easier. Spacer 23 includes guide edges 25 and 27 to limit movement of strike plates 24 and 26 to directions substantially transverse to long axis 16.

Assembly 100 further includes reinforcement tabs 57 and 59 in open areas 34 and 46, respectively. Like the previous embodiment, these open areas are configured to receive the latch mechanisms from the handle set and deadbolt. In this case, however, reinforcing tabs 57 and 59 provide additional strength and support to the door latches. This makes it even more difficult to knock in a door.

This view also shows adjusting screws 62 and 64 configured to engage threads 63 and 65, respectively, in plate 14. In contrast to the threaded bosses 58 and 60, threads 63 and 65 are simply bored into plate 12. These adjusting screws serve the same purpose of filling the gap between a prehung door jamb 80 and stud, as discussed with respect to the previous embodiment. This prevents the need for shims to be used in this area. Adjustment screws 66 and 68 can still be disposed through adjusting screws 62 and 64 to secure jamb 80 to stud 90.

A top cross-sectional view of assembly 100 installed on a door jamb 80 is shown in FIG. 5. This view shows a deadbolt assembly 130 attached to a door 132 with a door bolt 134 attached thereto via fastener 36. Door bolt 134 extends through strike plate 26 with a margin 136 between the door and the jamb. This view shows how plate 14 secures to jamb 80 via fastener 84. Adjusting screw 64 disposed through threaded screws 65 demonstrate how shims are no longer needed in this area to set the door. Tab 59 is also shown in this view. It is appreciated that if any force is applied in direction 63, door bolt 134 will engage tab 59 which adds resistance strength. This view also shows drywall 85 over wall studs 90 on one side and exterior subsiding 87 and exterior trim 89.

The exemplification set out herein illustrates one embodiment of the invention, and such exemplification is not to be construed as limiting the scope of the invention in any manner.

Although the present invention has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. A prehung door jamb assembly comprising:

a strike plate mounting assembly configured to fasten to a door jamb;

wherein said strike plate mounting assembly comprises:

a longitudinal extending support plate with a plurality of holes disposed therethrough configured to receive fasteners that secure the support plate to the door jamb;

a longitudinal extending second plate extending substantially orthogonal from the support plate;

first and second strike plate supports, both extending substantially orthogonal to the second plate, spaced apart and over top of the support plate so that both first and second strike plate supports are substantially parallel to the support plate; each first and second strike plate support including a pair of strike plate fastener slots configured to permit adjustment of an attached strike plate substantially transverse to the longitudinal extent of both the support and second plates; each first and second strike plate support also includes an open area configured to receive a latch mechanism from either a handle set or a deadbolt;

a spacer positioned between the first and second strike plate supports and including guide edges to limit movement of the strike plate to directions substantially transverse to the longitudinal extent of both the support and second plates;

at least one adjustment fastener configured to extend through the support plate and engage a door rough-in and configured to act as an adjustable spacer between the support plate and the door rough-in;

wherein the door rough-in is characterized as having a frame on a structure configured to receive the prehung door;

wherein the adjustment fasteners are adjustable to assist facilitating a desired spacing between the mounting assembly and the door rough-in;

at least one fastener configured to extend through the support plate and spacing and enter the door rough-in.

2. The prehung door jamb assembly of claim 1, wherein the strike plate mounting assembly further comprises first and second reinforcement tabs each positioned substantially parallel to the second plate and substantially orthogonal to the support plate and wherein the first reinforcement tab is located adjacent the open area of the first strike plate support and the second reinforcement tab is located adjacent the open area of the second strike plate support.

3. The prehung door jamb assembly of claim 1, wherein the strike plate mounting assembly includes the spacer being both spaced apart and over top of the support plate.

4. The prehung door jamb assembly of claim 1, wherein the strike plate mounting assembly includes a threaded bore in the support plate to receive corresponding threads from the adjustment fasters.

5. The prehung door jamb assembly of claim 4, wherein the strike plate mounting assembly includes each adjustment fastener having a bore disposed therethrough configured to receive the fastener.

6. The prehung door jamb assembly of claim 1, wherein the strike plate mounting assembly includes a boss that receives one of the adjustment fasteners.

7. The prehung door jamb assembly of claim 1, wherein the strike plate mounting assembly further includes each fastener configured to extend through a bore in the adjustment fastener and to extend into the door rough-in.

8. A prehung door jamb assembly comprising:

a door jamb;

a strike plate mounting assembly fastened to the door jamb;

wherein said strike plate mounting assembly comprises:

a first portion adapted to be secured at multiple points to a surface of the door jamb;

a second portion coupled to and extending substantially orthogonally from said first portion, said second portion being configured to align with an edge surface of the door jamb;

a third portion coupled to said second portion and extending substantially orthogonally therefrom, said third portion comprising two sets of slots for receiving fasteners used to secure strike plates to said strike plate mounting assembly; and at least one adjusting screw extending through said first portion and configured to contact a building structure following installation of the prehung door jamb so as to support the strike plate mounting assembly relative to the building structure.

* * * * *